US008561718B2

(12) United States Patent
Calleri

(10) Patent No.: US 8,561,718 B2
(45) Date of Patent: Oct. 22, 2013

(54) SYSTEM AND METHOD FOR THE THERMAL CONDITIONING OF A FLUID MORE PARTICULARLY A DRILLING MUD

(75) Inventor: Antonio Calleri, Milan (IT)

(73) Assignee: Geolog S.r.l., Milan (IT)

( * ) Notice: Subject to any disclaimer, the term of this patent is extended or adjusted under 35 U.S.C. 154(b) by 218 days.

(21) Appl. No.: 13/185,884

(22) Filed: Jul. 19, 2011

(65) Prior Publication Data

US 2013/0020128 A1 Jan. 24, 2013

(51) Int. Cl.
*E21B 7/00* (2006.01)

(52) U.S. Cl.
USPC ..... 175/17; 95/178

(58) Field of Classification Search
USPC ..... 175/17; 73/19.09, 19.1; 422/68.1; 95/178, 179, 254
See application file for complete search history.

(56) References Cited

U.S. PATENT DOCUMENTS 4,492,839 A * 1/1985 Smith ..... 219/684
6,221,167 B1 * 4/2001 Karasawa ..... 134/1
6,307,191 B1 * 10/2001 Waycuilis ..... 219/687
7,503,227 B2 * 3/2009 Davis et al. ..... 73/861.42
7,587,290 B2 * 9/2009 Scott ..... 702/100
2002/0011487 A1 * 1/2002 Matsuo et al. ..... 219/688
2002/0101373 A1 * 8/2002 Arndt et al. ..... 342/124
2008/0319685 A1 * 12/2008 Xie et al. ..... 702/45
2009/0194528 A1 * 8/2009 Kotzian et al. ..... 219/690
2010/0031754 A1 * 2/2010 Atkinson ..... 73/861.04
2010/0089120 A1 * 4/2010 Hanson ..... 73/19.02
2010/0130387 A1 * 5/2010 Davis et al. ..... 507/103
2012/0088950 A1 * 4/2012 Dodds et al. ..... 588/310
2012/0305496 A1 * 12/2012 Zadyraka et al. ..... 210/748.07
2012/0312530 A1 * 12/2012 Pope et al. ..... 166/250.01

FOREIGN PATENT DOCUMENTS

CN 201973886 U * 9/2011
GB 2232902 A * 1/1991

* cited by examiner

*Primary Examiner* — Daniel P Stephenson
(74) *Attorney, Agent, or Firm* — John Alumit

(57) ABSTRACT

A system for the thermal conditioning of a fluid, more particularly a drilling mud, in Preparation for subsequent cycles of analysis of the composition of the fluid. The system provides for the presence of at least one generator of microwaves for heating the fluid, and a cylinder of non-stick material. The fluid flows through the cylinder such that the heating of the mud takes place in less than 70 seconds.

9 Claims, 2 Drawing Sheets

SYSTEM AND METHOD FOR THE THERMAL CONDITIONING OF A FLUID MORE PARTICULARLY A DRILLING MUD

CROSS-REFERENCE TO RELATED APPLICATION

This application claims the benefit of the priority filing date of Italian patent no. MI2010A001324 filed on Jul. 19, 2010 in the name of GEOLOG S.p.A.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates to a system and a method of thermal conditioning as a continuous process of a fluid sample, more particularly of an oil drilling mud During the drilling of an oil well, a fluid known as drilling mud is made to circulate inside the hole while drilling. The drilling mud has various functions including, in particular, those of: supporting the drilled hole, lubricating and cooling the auger while drilling of the well. The drilling mud has, moreover, the function of conveying rock fragments to the surface produced while drilling. The rock fragments are produced by the mechanical impact of the drill bit traversing the rocky layer, resulting in drilling debris and volatile substances released during the break-up action.

Among fluids and gaseous components, liquid and gaseous hydrocarbons are of particular importance because they are indicators of the existence of an oil or gas deposit.

The gaseous fraction contained in the drilling mud conveyed to the surface is commonly extracted by means of an apparatus known as degasser, after which it is diluted in a carrier gas, generally air, and finally transferred to various analysis apparatuses able to identify the quality and quantity of various components of hydrocarbons present. The degasser is continuously fed by a volumetric pump which samples the fluid to be degassed at the point closest to the well exit.

In certain working conditions, in particular in the drilling of wells in deep waters (from 1000 to 3000 metres of water), the drilling mud must upwardly traverse a column of water of considerable height, cooling progressively, before reaching the point of sampling. Due to this cooling, the drilling mud that reaches the degasser has a temperature often below 10° C. Such a temperature entails considerable difficulties in extracting and analyzing the hydrocarbons present.

Also, in these conditions, the rise of mud is at times aided by a supplementary pump that injects drilling mud already degassed into a circuit rising from the seabed, in this way diluting the mud coming from the well and consequently the gaseous fraction contained therein. This considerably reduces the percentage of hydrocarbons present in unit of volume, making their extraction and quantification additionally difficult.

For these reasons, the hydrocarbons brought to the surface may be in extremely low concentrations (and in two-phase gas/liquid equilibrium), conditions which as a whole make the subsequent process of extraction and analysis in gaseous phase very difficult.

It is therefore necessary to thermally, i.e. heat, condition the drilling mud so as to facilitate the extraction of the hydrocarbons thereby improving the precision and resolution of their subsequent analysis.

The systems for thermal conditioning of drilling mud currently present on the market are essentially electric heating systems that use plate heat exchangers. These systems, however, have various disadvantages, including the length of time interval required for raising the temperature of the drilling mud, which consequently delays the sending of the gas sample for subsequent qualitative and quantitative hydrocarbon analysis. This delay may be particularly hazardous in light of the particular risks involved in handling certain gases.

SUMMARY OF THE INVENTION

The object of the present invention is that of providing a system of thermal conditioning of a fluid, in particular, oil drilling mud, which allows its temperature to be quickly raised beyond the volatility limit of its components to be analysed. In particular, while known systems of heating take up to 15 minutes to bring the temperature to a sufficient value (approximately 80° C.) for the complete extraction of hydrocarbons, the present system achieves the same objective in less than 70 seconds.

This object is achieved by a system of heating based on microwaves which achieves rapid rising of temperatures. This feature permits the sample of heated mud to reach the subsequent stage of extraction and analysis considerably earlier compared to known systems, and to give advance notice of possible dangers connected to the presence of gas. This allows for more time to adopt measures to safeguard persons, the environment, and equipment.

Secondly, yet equally importantly, this feature of reducing heating/transit times provides a more representative sample and a better analytical resolution of the various components in the subsequent phase of analysis.

Another considerable disadvantage of known systems of heating comes from the formation of solid residues (incrustations) caused by heating mud at high temperatures. These incrustations may cause blockages in the labyrinth paths of plate exchangers, consequently interrupting the process.

A second object of the present invention, therefore, is that of providing a system of thermal conditioning of a drilling mud which does not allow the formation and deposit of solid residues (incrustations) produced by the heating of fluid. This object is achieved due to the simultaneous presence of several elements: the elimination of typical labyrinth paths of plate exchangers which, due to their actual configuration, are subject to blockages; the use of microwaves which allow rapid heating and which does not generate incrustations; and the use of a pipe of non-stick material as a container in which to make the mud flow adequate for specific working conditions.

Another typical problem of systems of thermal conditioning comes from the formation and consequent accumulation of gaseous bubbles inside a circuit. A third object of the present invention, therefore, is that of completely eliminating the risk of separation and accumulation of gaseous bubbles inside the circuit. This object is achieved by eliminating the typical labyrinth paths of heat exchangers which, due to their geometric configuration, often causes the formation of bubbles, and the use of a rectilinear pipe of non-stick material as container in which to make the mud flow A final disadvantage which may be encountered with known systems comes from the likelihood that blockages may occur due to a solid component which is normally present in drilling mud. In known systems of thermal conditioning, it is necessary to filter mud beforehand in order to eliminate any solid component. The prior ultra-filtering of the mud may also cause the elimination of a part of the gaseous component which should instead be retained and analysed. Therefore, a further object of the present invention is that of providing a system of thermal conditioning of drilling mud which allows for the circulation of a fluid also containing a solid component (which naturally must not have excessive dimensions) in order to avoid prior ultra-filtering. This object is also achieved by eliminating the labyrinth paths of plate exchangers whose geometric features may cause the formation of blockages, and the use of an adequate section a rectilinear pipe of non-stick material as container in which to make the mud flow.

These and further features of the present invention will be made clearer on reading the following detailed description of a preferred embodiment of the present invention to be considered by way of a non-limiting example of the more general concepts claimed.

BRIEF DESCRIPTION OF THE DRAWINGS

The following description refers to the accompanying drawings, in which.

DESCRIPTION OF THE PREFERRED EMBODIMENT OF THE INVENTION

Figure 1:
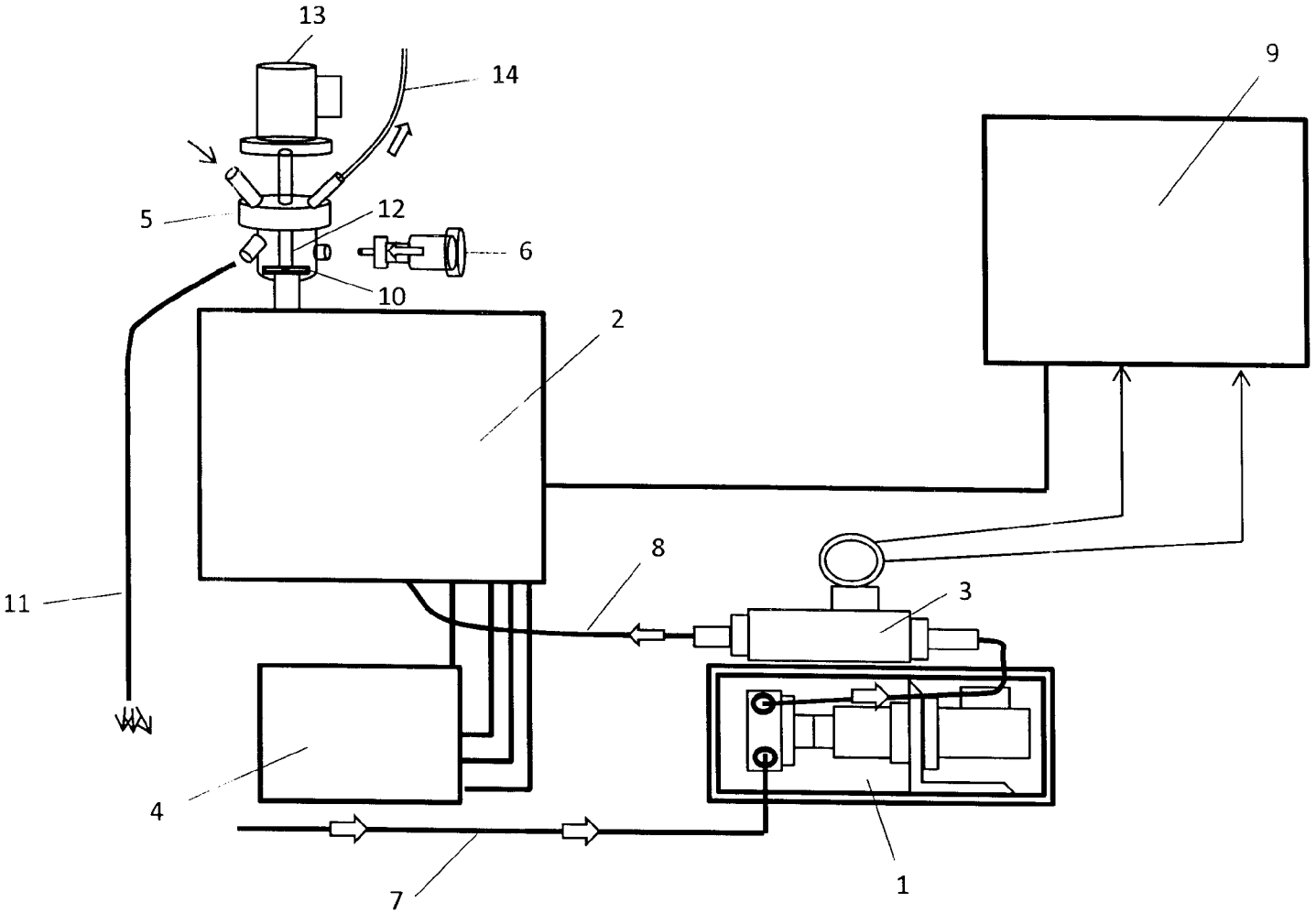
FIG. 1 is an exemplary diagram of the functioning of a system of extraction, thermal conditioning and degassing of drilling mud, considered as a whole.

Referring to FIG. 1, a system for the extraction, thermal conditioning and degassing of drilling mud is made up of the following main elements:

- a volumetric pump 1
- a system of thermal conditioning of the mud 2
- a measurer 3 of the flow and temperature at input in said conditioning system
- a pneumatic box 4 for maintaining the system of thermal conditioning under safety conditions
- a degasser 5
- a measurer 6 of the temperature at output.

The functioning of the system made up of the elements described above is described herein below. The drilling mud comes from the probe via the line 7 arrives at the volumetric pump 3. The latter pushes the mud towards the box which encloses the system of thermal conditioning 2. On the line 8, along which flows the mud which arrives at the box of the system of thermal conditioning, a measurer 3 of flow and temperature is placed. The value of temperature and flow at input in the system of thermal conditioning measured by the device 3 is sent to the electronic block 9 placed in a cabin in a safe area.

During the traversing of the box of thermal conditioning, the drilling mud is heated, raising the temperature to a sufficient value (approximately 80° C.) for the complete extraction of the hydrocarbons present, in a time less than 70 seconds. After heating, the temperature of the mud is once again measured by means of the measurer of the temperature at output 6. The value of the temperature at output measured by 6 is sent to the electronic block placed in the cabin where the measurement of the temperature at input also arrives, so as to monitor the heating procedure. The temperature values, measured and acquired by the control unit placed inside the control cabin situated in a safe area, are used to pilot the modules of heating with microwaves in order to maintain a constant temperature which is adequate for the purpose. The mud at output from the box of thermal conditioning arrives at the degasser 5. Said degasser 5 is made up of a cylindrical container provided below with an input mouth 10 and laterally with a discharge mouth 11 for the drilling mud.

Inside the cylindrical container there is a mechanical stirrer 12 actuated by an electric motor 13 to create a centrifugal movement of the mud which encourages the separation upwards of the gaseous fraction.

The gas which is separated at the head of the cylindrical container is conveyed by means of a vacuum line 14 to the apparatuses for the qualitative and quantitative analysis of the gas sample.

Figure 2:
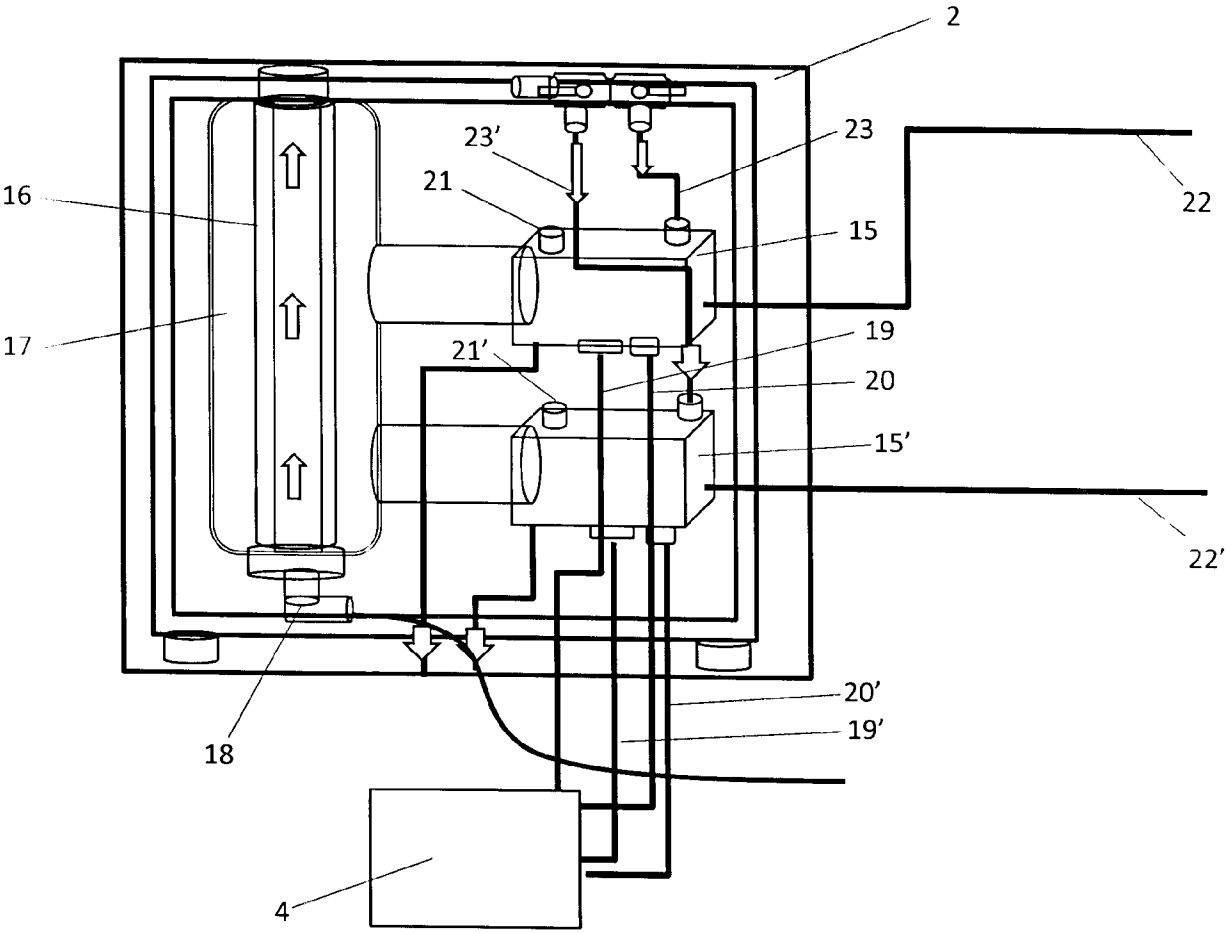
FIG. 2 shows only the system of thermal conditioning of drilling mud.

Referring to FIGS. 1 and 2, the system of thermal conditioning 2 according to the present invention is made up of:

- a first generator of microwaves 15
- a second generator of microwaves 15'
- a fluxing cylinder 16 in non-stick material with features that are adequate for the specific working conditions
- a container 17 of the fluxing cylinder in Teflon.

The drilling mud enters the interior of the system of heating by means of the input mouth 18 and traverses the fluxing cylinder 16. During the traversing of the fluxing cylinder 16, the mud is heated by microwaves produced by the two generators 15 and 15'. The generators of microwaves are connected by means of the lines 19 and 20, 19' and 20' to the pneumatic box of pressurisation 4 and are provided with safety valves 21 and 21'. The maintaining of an overpressure inside the system also allows the installation of the apparatus in areas considered potentially hazardous (zone 1 and zone 2).

As an alternative to the system described above, it is possible to use other solutions to allow the installation in hazardous areas. These solutions are, for example, "intrinsic safety" and "anti-deflagration"

Said generators of microwaves 15 and 15' are connected via the two supply lines 22 and 22' to the control unit placed inside the control cabin situated in a safe area.

The fluxing cylinder is a pipe preferably in non-stick material with features notoriously adequate for the specific working conditions, able to prevent the formation of solid residues or incrustations. At the output from the fluxing cylinder, the mud arrives at the cylindrical container of the degasser where mechanical stirring takes place for the separation of the gaseous hydrocarbons.

The generators of microwaves 15 and 15' are provided with two cooling circuits 23 and 23' preferably with water or with air. A system is thus made for the heating of the drilling mud, able to quickly heat said mud so as to make the entire procedure of detecting the presence of gaseous hydrocarbons faster.

From the description given above, it is possible to note the total lack of the typical labyrinth paths of heat exchangers. In the present invention, in fact, during the operation of heating, the mud only passes through a fluxing cylinder of non-stick material. The simple geometry of such a path and the features of anti-adherence of the material whereof said path is constituted, combined with the use itself of the microwaves, results in a device capable of overcoming all the limitations of known thermal conditioning devices in an efficient manner.

What is claimed is:

1. A system for the thermal conditioning of a drilling mud, in preparation for subsequent cycles of analysis of the composition of said drilling mud, wherein said system comprises at least one generator of microwaves for the heating of said drilling mud and a cylinder wherein said drilling mud flows:

said cylinder made up of non stick material with features adequate to avoid the formation of solid residues or incrustation of said drilling mud within a path traversed;

said generator of microwaves connected to said cylinder in such a way as to heat the drilling mud contained inside said cylinder; and said generator of microwaves connected to a pneumatic box of pressurization.

2. The system for the thermal conditioning of a drilling mud, in preparation for subsequent cycles of analysis of the composition of said drilling mud according to claim 1, wherein the heating of the mud takes place in less than 70 seconds.

3. The system for the thermal conditioning of a drilling mud, in preparation for subsequent cycles of analysis of the composition of said drilling mud according to claim 1, wherein said generators of microwaves are placed inside over-pressurized containers suitable for functioning in an explosive area.

4. The system for the thermal conditioning of a drilling mud, in preparation for subsequent cycles of analysis of the composition of said drilling mud, according to claim 1, wherein said generators of microwaves are made safe for functioning in an explosive area by means of an intrinsic safety method.

5. The system for the thermal conditioning of a drilling mud, in preparation for subsequent cycles of analysis of the composition of said drilling mud, according to claim 4, wherein said generators of microwaves are made safe for functioning in an explosive area by means of an anti-deflagration method.

6. The system for the thermal conditioning of a drilling mud, in preparation for subsequent cycles of analysis of the composition of said drilling mud, according to claim 1, further comprising a circuit for cooling preferably with water.

7. The system for the thermal conditioning of a drilling mud, in preparation for subsequent cycles of analysis of the composition of said drilling mud, according to claim 1, wherein it comprises a circuit for cooling preferably with air.

8. The system for the thermal conditioning of a drilling mud, in preparation for subsequent cycles of analysis of the composition of said drilling mud, according to claim 1, wherein the fluid at output from said system is subjected to degassing and the gases extracted are subjected to a subsequent composition analysis.

9. The system for the thermal conditioning of a drilling mud, in preparation for subsequent cycles of analysis of the composition of said drilling mud, according to claim 1, further comprising two devices for the measurement of the temperature of said fluid: one for measuring the temperature at input in said system and one for measuring the temperature at output in said system.

* * * * *